US009852875B2

(12) United States Patent
Wall

(10) Patent No.: US 9,852,875 B2
(45) Date of Patent: Dec. 26, 2017

(54) X-RAY TUBE

(71) Applicant: Bruker JV Israel Ltd., Migdal HaEmek (IL)

(72) Inventor: John Leonard Wall, Durham (GB)

(73) Assignee: BRUKER JV ISRAEL LTD., Migdal Haemek (IL)

( * ) Notice: Subject to any disclaimer, the term of this patent is extended or adjusted under 35 U.S.C. 154(b) by 0 days.

(21) Appl. No.: 15/657,153

(22) Filed: Jul. 23, 2017

(65) Prior Publication Data

US 2017/0323759 A1 Nov. 9, 2017

Related U.S. Application Data

(62) Division of application No. 14/849,647, filed on Sep. 10, 2015, now Pat. No. 9,748,070.

(60) Provisional application No. 62/051,303, filed on Sep. 17, 2014.

(51) Int. Cl.

*H01J 35/10* (2006.01)
*H01J 35/18* (2006.01)
*H01J 35/08* (2006.01)

(52) U.S. Cl.

CPC ..... *H01J 35/106* (2013.01); *H01J 35/08* (2013.01); *H01J 35/18* (2013.01); *H01J 2235/086* (2013.01); *H01J 2235/088* (2013.01); *H01J 2235/1204* (2013.01); *H01J 2235/1262* (2013.01)

(58) Field of Classification Search

CPC ..... H01J 35/10; H01J 35/105; H01J 35/106; H01J 35/26; H01J 2235/12; H01J 2235/1204; H01J 2235/1262; H01J 2235/1266; H01J 2235/1275; H01J 2235/1287

See application file for complete search history.

(56) References Cited

U.S. PATENT DOCUMENTS 4,119,855 A * 10/1978 Bernacki ..... G03F 7/70033 250/492.2
4,788,705 A * 11/1988 Anderson ..... H01J 35/04 378/101
5,018,181 A * 5/1991 Iversen ..... H01J 35/106 378/130
5,105,456 A * 4/1992 Rand ..... H01J 35/106 378/125
8,953,746 B2 * 2/2015 Roshi ..... H01J 35/06 378/125
9,748,070 B1 * 8/2017 Wall ..... H01J 35/106
2011/0188625 A1 * 8/2011 Roshi ..... H01J 35/06 378/4
2012/0128117 A2 * 5/2012 Roshi ..... H01J 35/06 378/4

* cited by examiner

*Primary Examiner* — Thomas R Artman
(74) *Attorney, Agent, or Firm* — D. Kligler IP Services Ltd.

(57) ABSTRACT

An X-ray tube includes a cathode, which is configured to generate an electron beam, and a round anode, which is configured to rotate such that the electron beam impinges on a rotating surface of the anode so as to emit at least one X-ray beam. An array of gas pipes is configured to direct gas onto the surface so as to cool the anode.

6 Claims, 6 Drawing Sheets

X-RAY TUBE

CROSS-REFERENCE TO RELATED APPLICATIONS

This application is a division of U.S. patent application Ser. No. 14/849,647, filed Sep. 10, 2015, which claims the benefit of U.S. Provisional Patent Application 62/051,303, filed Sep. 17, 2014, whose disclosure is incorporated herein by reference.

FIELD OF THE INVENTION

The present invention relates generally to X-ray tubes, and particularly to X-ray tube anodes.

BACKGROUND OF THE INVENTION

X-ray beams can be used for characterizing a large range of materials including materials used in the semiconductor industry. Various methods have been developed for generating X-ray beams. For example, U.S. Pat. No. 7,257,193, to Radley, et al., whose disclosure is incorporated herein by reference, describes an X-ray source assembly having enhanced output stability using tube power adjustments and remote calibration. A control system is provided for maintaining intensity of the output X-rays dynamically during operation of the X-ray source assembly, notwithstanding a change in at least one operating condition of the X-ray source assembly, by changing the power level supplied to the assembly.

European Patent 2,050,100, to Boulee, et al., whose disclosure is incorporated herein by reference, describes a system for delivering an X-ray beam, comprising a source block that emits a source X-ray beam and conditioning means for conditioning the source beam sent towards a specimen. The system includes stabilization means designed to thermally stabilize a region of the system lying downstream of the source block, in order to limit heat transfer towards the conditioning means for the purpose of preventing thermal perturbations in the conditioning means.

U.S. Pat. No. 6,282,263, to Arndt, et al., whose disclosure is incorporated herein by reference, describes an X-ray generator which produces an X-ray source having a focal spot or line of very small dimensions and which is capable of producing a high intensity X-ray beam at a relatively small point of application using a low operating power.

U.S. Pat. No. 6,788,633, to Loxley, et al., whose disclosure is incorporated herein by reference, describes a method and apparatus for prolonging the life of an X-ray target. An X-ray generator comprises an evacuated and sealed X-ray tube, containing an electron gun and an X-ray target. An electron beam is produced by the electron gun in which the cathode is at negative high voltage, the electron gun consisting of a filament just inside the aperture of a Wehnelt grid which is biased negatively with respect to the filament.

U.S. Pat. No. 4,675,890, to Plessis, et al., whose disclosure is incorporated herein by reference, describes an X-ray tube for producing a high-efficiency beam and especially a pencil beam as applicable to the field of radiology and more especially digital radiology, comprises an anode provided with a rectilinear bore and a cathode for generating an electron beam which enters the bore. The internal walls of the bore constitute an anode target which is bombarded by the electron beam in order to produce at least one x-ray beam which emerges from one end of the bore.

U.S. Pat. No. 5,148,462, to Spitsyn, et al., whose disclosure is incorporated herein by reference, describes formation of high thermal conductivity X-ray anode sources for production of high intensity X-rays. The anode sources are structures containing diamond (passive element) and desired target material(s) consisting of metal(s) and (or) their alloys for the generation of high intensity X-radiation of the desired wavelength.

SUMMARY OF THE INVENTION

An embodiment of the present invention that is described herein provides an X-ray tube including a cathode and an anode. The cathode is configured to generate an electron beam. The anode has at least one hole that faces the electron beam, the hole having sidewalls and a floor. The electron beam impinges on one or more of the sidewalls of the at least one hole so as to emit a first X-ray beam at angles that are not orthogonal to a surface of the anode. The electron beam also impinges on the floor of the at least one hole so as to emit a second X-ray beam, at least some of which is emitted at an angle that is orthogonal to the surface of the anode.

In some embodiments, the floor has a curved depth profile. In an embodiment, the at least one hole includes at least first and second holes. In an example embodiment, the first and second holes differ in diameter. In a disclosed embodiment, the tube includes a film that covers a surface of the anode facing the electron beam, including the at least one hole, so as to protect the anode from the impinged electron beam and to isolate the cathode in a vacuum environment.

In another embodiment, the anode includes at least one cooling channel, which is configured to transport gas through the at least one hole so as to control a temperature of the anode. In yet another embodiment, the anode includes stacked layers of two or more materials, and is configured to emit the first X-ray beam at one or more wavelengths corresponding to the materials.

In some embodiments, a cross-section of the first X-ray beam has an annular shape. In an embodiment, a cross-section of the at least some of the second X-ray beam covers at least a center of the annular shape.

In yet other embodiments, the anode includes a tape, which covers a distal end of the at least one hole, such that the electron beam impinges on the tape so as to emit an additional X-ray beam. The tape may be configured to move relative to the electron beam. In an embodiment, the tape includes one or more materials, and is configured to emit the additional X-ray beam at wavelengths corresponding to the materials.

There is additionally provided, in accordance with an embodiment of the present invention, an X-ray tube including a cathode, a round anode and an array of gas pipes. The cathode is configured to generate an electron beam. The round anode is configured to rotate such that the electron beam impinges on a rotating surface of the anode so as to emit an X-ray beam. The array of gas pipes is configured to direct gas onto the surface so as to cool the anode.

There is also provided, in accordance with an embodiment of the present invention, a method including, in an X-ray tube, generating an electron beam by a cathode. The electron beam is directed onto an anode having at least one hole that faces the electron beam, the hole having sidewalls and a floor. The electron beam impinges on one or more of the sidewalls of the at least one hole so as to emit a first X-ray beam at angles that are not orthogonal to a surface of the anode. The electron beam also impinges on the floor of the at least one hole so as to emit a second X-ray beam, at least some of which is emitted at an angle that is orthogonal to the surface of the anode.

There is further provided, in accordance with an embodiment of the present invention, a method for producing an X-ray tube. The method includes providing a cathode, which is configured to generate an electron beam, and an anode. At least one hole is formed in the anode, facing the electron beam. The hole has sidewalls and a floor such that, in response to the electron beam, the sidewalls are configured to emit a first X-ray beam at angles that are not orthogonal to a surface of the anode, and the floor is configured to emit a second X-ray beam, at least some of which is emitted at an angle that is orthogonal to the surface of the anode.

The present invention will be more fully understood from the following detailed description of the embodiments thereof, taken together with the drawings in which:

BRIEF DESCRIPTION OF THE DRAWINGS

FIGS. 2-8A are schematic sectional views of anodes used in X-ray generating tubes, in accordance with embodiments of the present invention;

DETAILED DESCRIPTION OF EMBODIMENTS

Overview

Figure 1:
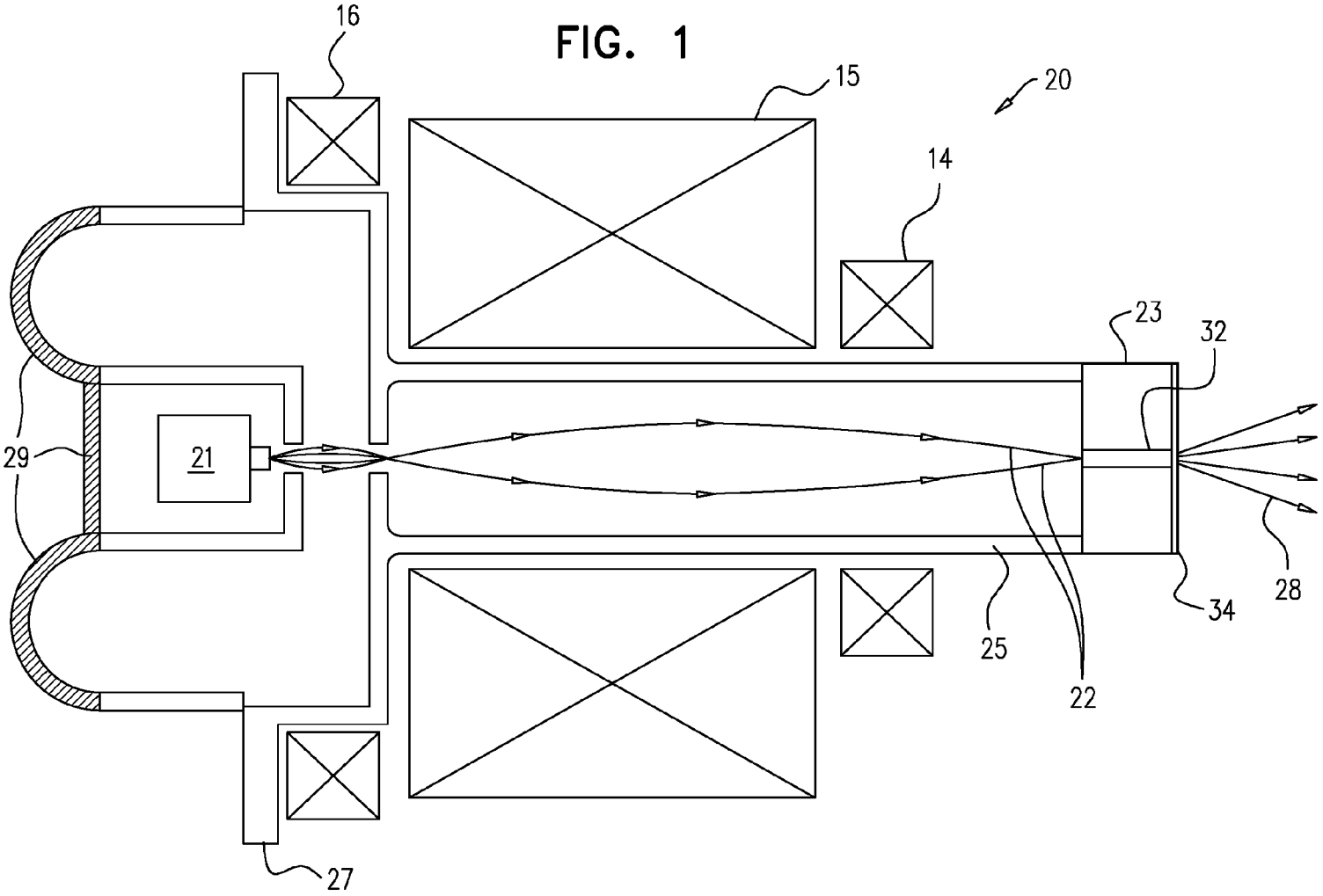
FIG. 1 is a block diagram that schematically illustrates an X-ray source assembly, in accordance with an embodiment of the present invention.

Compact, micro-focus X-ray tubes are used in a variety of measurement systems, including X-ray characterization and metrology tools for the semiconductor industry. An X-ray tube typically comprises a cathode and a metal anode (e.g., copper) that typically operate in vacuum environment within the tube. The cathode is configured to generate a high-energy electron beam which is accelerated and directed to impinge on the anode. The beam interacts with the copper atoms of the anode so as to generate an X-ray beam.

Using a high-energy electron beam may be advantageous for generating the X-ray, but may overheat the anode and cause sublimation of the anode. As a result, the vacuum within the tube may suffer rapid degradation that negatively affects the quality of the electron beam and reduces the lifetime of the tube. To reduce the damage that the electron beam causes to the anode, it is possible in principle to use a broader electron beam having reduced energy density. A broader electron beam, however, typically results in X-rays of larger spot size, which is generally undesired.

Embodiments of the present invention that are described hereinbelow provide an anode to be used in an X-ray tube. The disclosed anode configurations enable the electron beam to impinge on a large surface area at maximum power loading, so as to achieve high brightness X-rays, and at the same time retain a small X-ray spot size.

In some embodiments, the anode comprises a bulk with one or more holes that face the electron beam, such that the electron beam impinges on sidewalls of the holes so as to emit the X-ray beam. The sidewalls are typically made of an x-ray emitting material such as copper, molybdenum, or tungsten. In other embodiments, the hole may comprise a thin walled hollow tube surrounded by high thermal conductivity material such as diamond, or sapphire. The holes do not penetrate through the entire bulk, such that the remaining "floors" of the holes serve as additional anode surfaces. The floor emits the X-ray beam orthogonally to the lower surface of the anode in a transmission mode while the sidewalls emit the X-ray beam at angles that are oblique relative to the lower surface of the anode at a reflective mode.

The hole geometry increases the surface area of the anode impinged by the electron beam, and thus allows using a maximum power of the electron beam so as to increase the intensity of the emitted X-ray from the anode. The X-ray beam emitted from the sidewalls typically has an annular cross-section, which is impractical or at least sub-optimal in some applications. The additional X-ray radiation emitted from the floor essentially fills the center of this annular cross-section.

In some embodiments, the anode may comprise multiple holes, each hole functioning as a separate anode. The electron beam impinges on a single hole at a given time. In an embodiment the diameter of the holes is uniform (e.g., 50 μm) across the anode, and thus, all the holes emit substantially similar X-ray beams. For example, when a given hole is blocked or damaged, the electron beam may be steered to impinge on another hole of the anode.

In an embodiment, the holes may have different respective diameters so as to enable generating X-ray beams having different properties (e.g., angle or intensity). This capability may be useful for specific inspection and measurement applications.

In an embodiment, the anode may comprise more than one type of metal. Each metal type emits X-ray photons at a different spectrum of wavelengths corresponding to a different energy-gap associated with the metal atoms. Using multiple different bulk metals in the anode allows producing a wide spectrum of wavelengths. For example, by directing the electron beam to holes formed in selected locations of the anode, a user may be able to control the spectrum of the emitted X-rays.

In some embodiments, the metal bulks may be arranged horizontally (side-by-side) so that directing the electron beam on a hole of a given bulk provides the user with a narrow and well-defined spectrum. In alternative embodiments, arranging the metals in a vertical stack and directing the electron beam on the sidewalls of the holes may result in X-ray photons emitted from multiple metal elements at a wide range of wavelengths corresponding to the metal layers.

The electron beam spot and the average diameter of the holes are typically on the same range (e.g., 50 μm). Electron beam that is not aligned to the hole may result in high density of electrons impinging on the surface of the anode, generating local overheat and may result in a sublimation of the metal atoms. The evaporated metal atoms may degrade the vacuum in the tube and thus, degrade the electron beam, reduce the intensity of the X-rays and may shorten the lifetime of the cathode.

In some embodiments, a thin protective film made of a superior heat-conductive material, such as diamond, may be used to protect the anode from sublimation and to seal the cathode from vapors that are emitted from the anode. The protective layer allows utilization of higher electron beam energy and thus, to generate X-rays having high intensity without risking the cathode. Higher electron-beam energy allows operating the anode at an atmospheric environment rather than in vacuum. In an embodiment, the anode comprises internal cooling channels patterned in the anode bulk so as to allow cooling of the anode with a suitable gas, such as air. The cooling air may flow through the hole so as to cool the sidewalls of the hole (in addition to known cooling methods at the perimeter of the anode, such as water cooling), and thus, enable higher intensity of X-ray emission from the anode.

In alternative embodiments, the anode may comprise a moving tape (typically made of copper), which is cooled by forced air flowing through the channels. Thus, a fresh piece of tape can be introduced by rolling the tape, such that the electron beam impinges on a fresh section of the tape while the recently used sections move to the cooling area.

Operating the anode in atmospheric environment enables efficient control of the anode temperature. For example, rotating the anode in air is significantly easier and more efficient compared to applying the same operation in vacuum. In an embodiment, the cathode is sealed in a vacuumed housing and coated with a thin diamond film that allows the electron beam to pass through and reach the anode. The anode comprises a round-shaped copper bulk located in close proximity to the cathode and configured to rotate while the electrons are impinging on the surface of the anode. In addition, an array of air pipes positioned around the anode bulk improves the cooling efficiency by using forced cooling air in addition to water cooling in the perimeter of a conventional rotating anode.

The above techniques enable improved efficiency of the X-ray tube by allowing higher power of the electron beam, which results in higher intensity of the X-ray beam, without compromising the lifetime of the cathode or the beam quality. Furthermore, the above techniques provide the user of an X-ray machine with a controllable spectrum of the X-ray photons, and thus, achieve high flexibility and wide-range functionality for inspection and measurement applications in material characterization.

System Description

FIG. 1 is a block diagram that schematically illustrates an X-ray source assembly 20, in accordance with an embodiment of the present invention. Assembly 20 comprises a cathode 21 that generates electrons accelerated towards a transmission metal anode 23, in the form of a high energy electron beam 22, by a high potential difference of several tens of kV. Cathode 21 is mounted on an anode flange 27 that comprises an aperture for the electron beam and is electrically isolated from the anode flange by an insulator 29.

Two sets of beam deflection coils 16, which are configured to center the beam from cathode 21 on the aperture in anode flange 27, are deployed in two planes and mounted between cathode 21 and a focusing coil 15. Alignment coils 14, which are configured to align beam 22 with the aperture in anode 23, are located between coil 15 and anode 23. Anode 23 may be formed from any suitable metal, such as copper, molybdenum, or tungsten.

Cathode 21 and anode 23 are enclosed in a high vacuum envelope, which comprises a flight tube 25, anode flange 27 and insulator 29. Flight tube and anode flange are typically made of a UHV compatible stainless steel. Insulator 29 is typically made of glass or ceramic and provides an electrical insulation between cathode 21, anode flange 27 and anode 23. High energy electrons of beam 22 interact with metal atoms of anode 23, and generate an X-ray beam 28. In some embodiments, anode 23 may comprise a cylindrical hole 32 that ends at a copper film 34 so that the electron beam impinges on walls of the hole and on film 34 so as to generate X-rays as will be described below in details.

Figure 2:
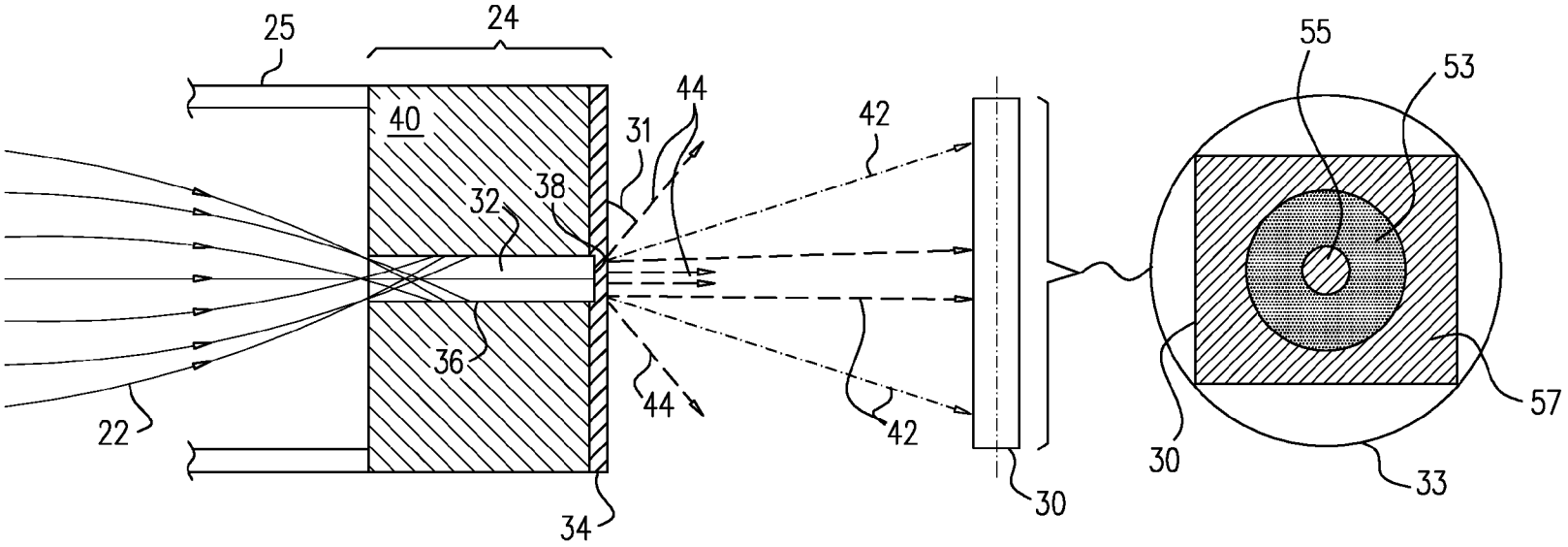

FIG. 2 is a schematic sectional view of an anode 24 and an imager screen 30, in accordance with an embodiment of the present invention. Anode 24 can be used, for example, as anode 23 in assembly 20 of FIG. 1 above. Anode 24 comprises a round bulk 40, typically made of 2 mm thick copper disk, and copper film 34 that is typically less than 10 μm thick. Cylindrical hole 32 of about 50 μm in diameter is formed in the bulk comprises sidewalls 36 and optionally, a floor 38, which serves as a transmission anode located on the upper surface of film 34.

In some embodiments, the cathode and the anode are held within an X-ray tube in vacuum (e.g., $10^{-5}$-$10^{-8}$ Torr) and film 34 seals the tube from the environment so as to prevent vacuum loss. Electron beam 22 impinges on sidewalls 36 and floor 38 (also denoted a film anode) so as to interact with the copper atoms of the bulk and to generate X-ray beams 42 and 44, respectively. Beams 42 are formed by electron beam 22 impinging on sidewalls 36 and are typically emitted through the lower surface of film 34 at non-orthogonal angles resulting in a spot 53 having an annular cross-section. Beam 44 is formed by electron beam impinging on floor 38 and emitted at a wide range of angles that may cover the entire area of screen 30.

An inset 33 provides a view of screen 30 from the X-ray tube. Annular spot 53 represents an area where both beams 42 and 44 impinge on screen 30. In addition, a first portion of beam 44 may emit from floor 38 at a substantially orthogonal angle relative to the lower surface of film 34, so as to impinge on screen 30 at an area 55.

A second portion of beam 44 may emit from floor 38 at an angle 31 (relative to film 34), which is smaller than the emitting angles of beam 42, thus the second portion may impinge on screen 30 at an area 57. The combination of beams 42 and 44 covers the entire area of screen 30 (as opposed to beam 42 that covers only annular spot 53). In some applications the floor is required to complement the annular spot of beams 42 with X-ray intensity (i.e., beam 44) in areas 55 and 57.

In other embodiments, film 34 below floor 38 is sufficiently thin to enable X-rays generated in sidewalls 36 to pass through, but still block electron beam 22 so that the energy of the beam electrons is used for generating X-ray beam 44.

Floor 38 typically comprises a flat surface, yet, in alternative embodiments, the floor may have a paraboloid, ellipsoidal or other curved depth profile so as to increase the overall reflections of the X-ray beam from the walls of the hole. In addition, the paraboloid or ellipsoidal depth profile may assist in focusing beams 42 on screen 30 and/or in directing the X-rays orthogonally, or at a low angle such as angle 31 to the lower surface of film 34 (so as to impinge on areas 55 and 57 of screen 30.

Sidewalls 36 typically comprise a flat vertical surface, yet, in some embodiments, the sidewalls may have a curved depth profile, such as a paraboloid or ellipsoidal, so as to optimize distribution of electrons impinging along the sidewalls of the anode. For example, a curved depth profile may be used for distributing of electrons uniformly along the sidewalls.

Figure 3:
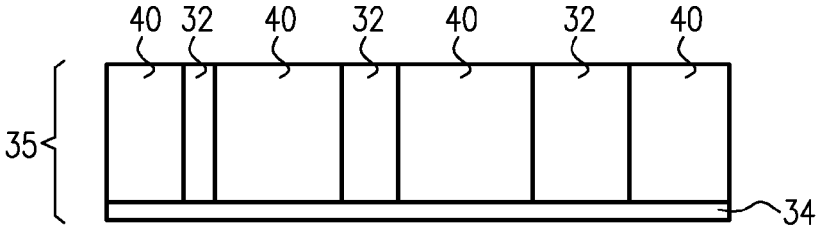

FIG. 3 is a schematic sectional-view of an anode 35 in accordance with another embodiment of the present invention. Anode 35 may serve, for example, as anode 23 in assembly 20 of FIG. 1 above. Anode 35 comprises bulk 40 having multiple holes 32. In some embodiments, the holes may have same or different diameters across the anode. In the example of FIG. 3, the left hole has smaller diameter than the middle and right holes. In other embodiments, the holes may have substantially similar diameter (e.g., 50 μm across the anode). The structure of anode 35 is substantially similar to that of anode 24 except for the multiple holes in anode 35 rather than a single hole in anode 24.

The electron beam typically impinges on a single hole at any given time. In an embodiment, multiple holes of the same diameter may provide the user with redundancy (e.g., in case holes become damaged). For example, a first hole in an array of similar holes may degrade by long exposure to the electron beam. As a result, the first hole will no-longer be able to generate the X-ray at the required quality. The user may apply a steering circuitry, such as electron optics incorporating electrostatic and or magnetostatic fields (not shown), to steer the electron beam to a second (undamaged) hole, which is substantially similar to the first hole, so as to impinge the electron beam on the second hole and to generate X-rays that meet the required specifications. In an embodiment, the user may steer the electron beam from the right hole of anode 35 to the left hole so as to modify the properties of the emitted X-rays.

Figure 4:
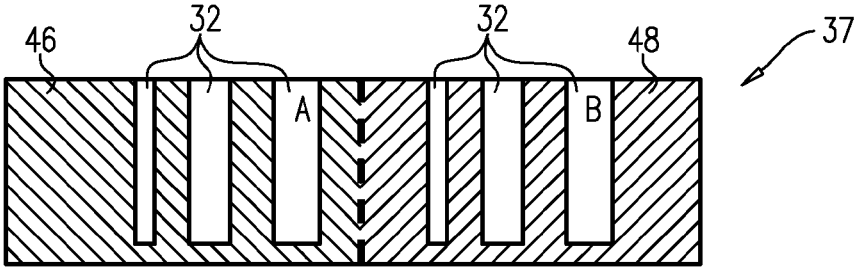

FIG. 4 is a schematic sectional-view of an anode 37 in accordance with another embodiment of the present invention. Anode 37 may serve, for example, as anode 23 in assembly 20 of FIG. 1 above. Anode 37 comprises two or more bulks, in the example of FIG. 4 sub-bulks 46 and 48 are inter-connected horizontally and are made of different respective materials, such as but not limited to copper, molybdenum, aluminum, cobalt, iron, rhodium, silver, and tungsten. The above-referenced materials may be used in any desired combination and are separated by a dotted line, which represents the interface between the bulks. Each of the materials listed above has a different energy gap between electrons around its nucleus. When electrons of the material are excited by beam 22 to a higher energy level and then return to their original energy band, the material emits photons whose wavelength depends on the respective energy gap.

In some embodiments, using an anode with two or more sub-bulks that are made of different materials, may provide the user with a possibility to switch from emitting X-rays of a given spectrum to a different respective spectrum by switching from a first hole located in sub-bulk 46 to a second hole located in sub-bulk 48.

Figure 5:
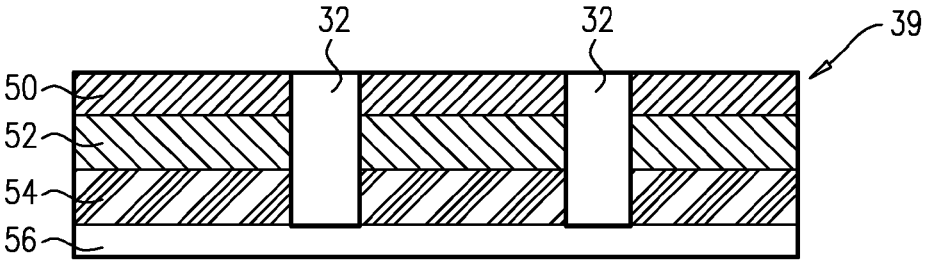

FIG. 5 is a schematic sectional-view of an anode 39 in accordance with another embodiment of the present invention. Anode 39 may serve, for example, as anode 23 in assembly 20 of FIG. 1 above. Anode 39 comprises multiple layers (or sub-bulks) 50, 52, 54 and 56, in an embodiment each layer may comprise a different material from the list described in FIG. 4. Alternatively, two or more of layers 50, 52, 54 and 56 may comprise a similar material from the same list. For example, layers 54 and 56 are made of copper, similar to film 34 shown in FIG. 2.

Beam 22 impinges on the sidewalls of holes 32, each sidewall comprises layers 50, 52, 54 and 56 that emit X-ray photons at a range of wavelengths as described in FIG. 4. In an embodiment, a user of the X-ray machine may control a spectrum of the emitted X-rays by directing beam 22 to impinge on selected layers along the sidewalls of holes 32. In another embodiment, holes 32 may comprise paraboloid or ellipsoidal cross-section profiles, as described in FIG. 2, so as to control the spectrum, the intensity and/or the angle of the emitted X-rays.

Figure 6:
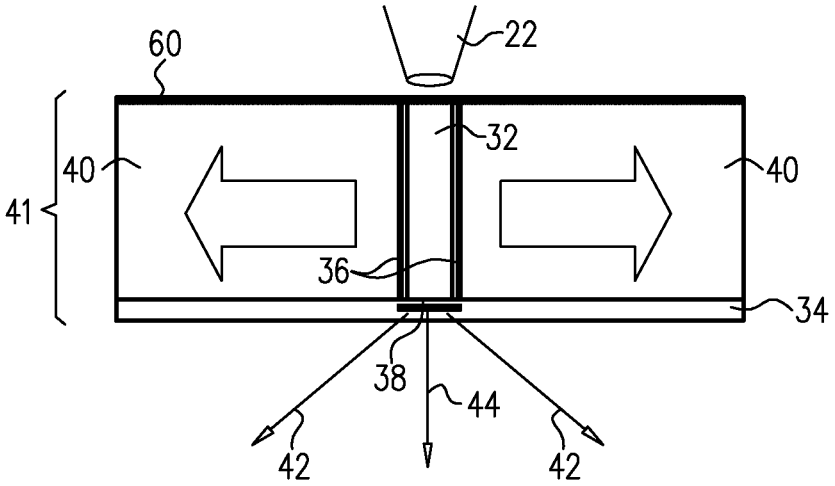

FIG. 6 is a schematic sectional-view of an anode 41 in accordance with another embodiment of the present invention. Anode 41 may serve, for example, as anode 23 in assembly 20 of FIG. 1 above. Anode 41 comprises a thin protective film 60, typically made of diamond, which is deposited on the upper surface of bulk 40 and seals hole 32. When impinging on anode 41, the spot of beam 22 undesirably generates local heating and sublimation of anode bulk 40. For example, at temperatures of about 600° C. the copper anode typically starts to evaporate into a gas that may damage the vacuum within the tube and thus, may reduce the quality of beam 22 and shorten the life time of the cathode. The thickness of film 60 depends on the anode material, the required X-ray intensity and the planned power of beam 22. For minimal absorption of the electron beam by the diamond film, the thickness of film 60 should be on the range of 10-300 μm.

In some embodiments, film 60 is made of a highly heat-conductive material, such as diamond, to dissipate the local heat developed in bulk 40 and to prevent potential vapors sublimated from the anode materials to interfere with the vacuum above the upper surface of film 60. This capability allows operating beam 22 at higher accelerating voltages (e.g., 100 keV rather than 50 keV that is used conventionally) and higher power density.

Operating the X-Ray Anode at Atmospheric Environment

Traditional X-ray tubes typically operate in vacuum environment (such as $10^{-8}$ Torr) so as to protect the cathode and to enable tight control of beam 22. By protecting the anode from vapors of the anode, film 60 enables the use of high accelerating voltage, which allows beam 22 to reach sidewalls 36 and floor 38 at an atmospheric environment. For example, electrons accelerated at 100 keV in air can reach as far as about 10 cm according to the completely slowing down approximation (CSDA) Range method of Berger and Seltzer (1964). The depth of hole 32 is typically about 2 mm, thus even for a 3 mm to 4 mm hole depth, at 100 keV, the energy loss of beam 22 when traversing the hole is sufficiently small even when hole 32 is filled with air.

Figure 7:
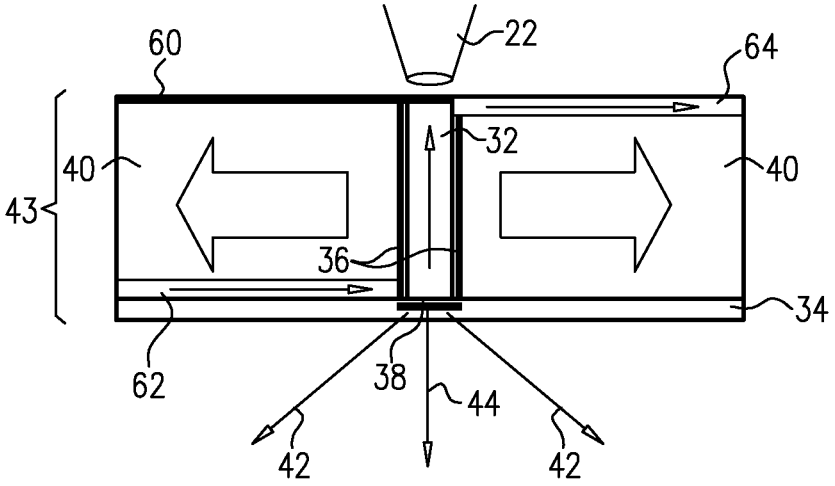

FIG. 7 is a schematic sectional-view of an anode 43 in accordance with another embodiment of the present invention. Anode 43 may serve, for example, as anode 23 in assembly 20 of FIG. 1 above. Anode 43 comprises film 60, which seals the cathode in vacuum as described in FIG. 6. Anode 43 further comprises cooling channels 62 and 64 patterned in the anode bulk so as to allow cooling of anode 43 with air or any other suitable gas.

In the example of FIG. 7, the cooling air enters the anode from the left side of channel 62 and flows in the right direction into hole 32 where it flows up so as to enter channel 64 from which it outflows to the right side of the anode. In some embodiments, the heat convection by air may operate in addition to other heat dissipation techniques, such as heat conduction by the metal bulk of the anode (from the center to the edge of the anode), or heat convection by water (or any other suitable liquid or gas) flowing at the perimeter of the anode.

Figure 8A:
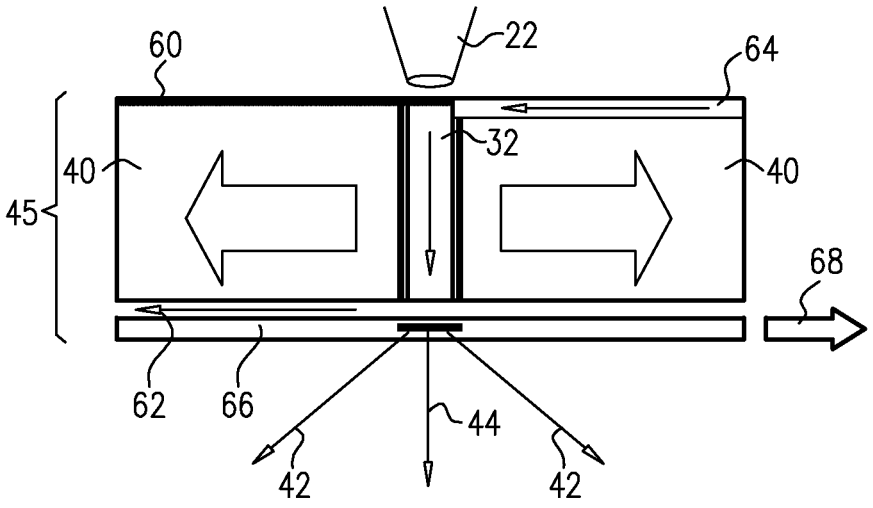

FIG. 8A is a schematic sectional-view of an anode 45 in accordance with another embodiment of the present invention. Anode 45 may serve, for example, as anode 23 in assembly 20 of FIG. 1 above. Anode 45 comprises film 60, which seals the cathode in vacuum. Alternatively, using high accelerating voltage eliminates the need for sealing hole 32 in vacuum. In the example of FIG. 8A, cooling air flows from right to left through channel 64, via hole 32, down to channel 62 and outflows from right to the left edge of anode 45.

Anode 45 further comprises a thin tape 66, typically made of copper, but may be made of any other suitable material or a combination of materials such as but not limited to molybdenum, aluminum, cobalt, iron, rhodium, silver, and tungsten. Beam 22 impinges on tape 66, which is a transmission target, similar to floor 38 shown in FIGS. 2, 6 and 7. The tape, however, does not have to be fixed to bulk 40 and can in fact move, thus increasing the power capacity of the tape. One possibility for such a moving tape encompasses a thin continuous copper tape around rollers (not shown), translated at high speed through the emerging electron beam. Tape 66 recirculates around the rollers at high speed, similar in concept to a liquid metal jet tube or any alternative suitable rotating anode tube.

Figure 8B:
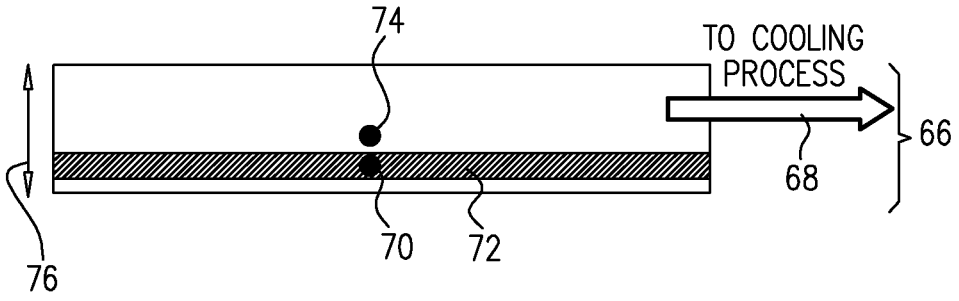
FIG. 8B is a schematic bottom-view of a tape in an anode that is used in an X-ray generating tube, in accordance with another embodiment of the present invention.

FIG. 8B is a schematic bottom-view of tape 66 in anode 45, in accordance with an embodiment of the present invention. Tape 66 is a heat-transmission target and thus, is heated by beam 22 and cooled by forced air flowing in channel 62. The power of beam 22 may ware out tape 66 over time as shown in a location 70. In some embodiments, a new piece of tape can be introduced by rolling the tape and thus, moving the tape with respect to beam 22 such that beam 22 impinges on a new section of the tape while the degraded location, such as location 70, moves to a cooling process (not shown but represented by an arrow 68). Strip 72 represents the new sections in tape 66 after the tape is moved by the rollers or by any other suitable moving technique.

In other embodiments, anode 45 comprises a motion element 76. Once the entire area of strip 72 is exposed to beam 22, element 76 is configured to move tape 66 by a vertical continuous raster type oscillation so as to move the exposed location of tape 66 from location 70 to another location 74, and thus, to improve the cooling efficiency of the tape. In yet other embodiments, the tape may revolve several hundreds of times through the cooling process before any part of the tape is impinged again by beam 22.

For example, for a tape that is 1 m long and 30 mm wide it is possible to use about 500 tracks by moving the tape up by 50 μm (a typical diameter of beam 22) every time the tape makes one pass through the electron beam. This sequence is equivalent to a rotating anode circumference of one (1) meter times 500 (i.e., 500 m) or to a rotating anode diameter equivalent of 159 m.

Tape 66 should at least 10 μm thick so as to allow the emission of X-rays from hole 32, and yet, to have sufficient mechanical strength to withstand the fast motion in the rollers and in element 76.

Figure 9:
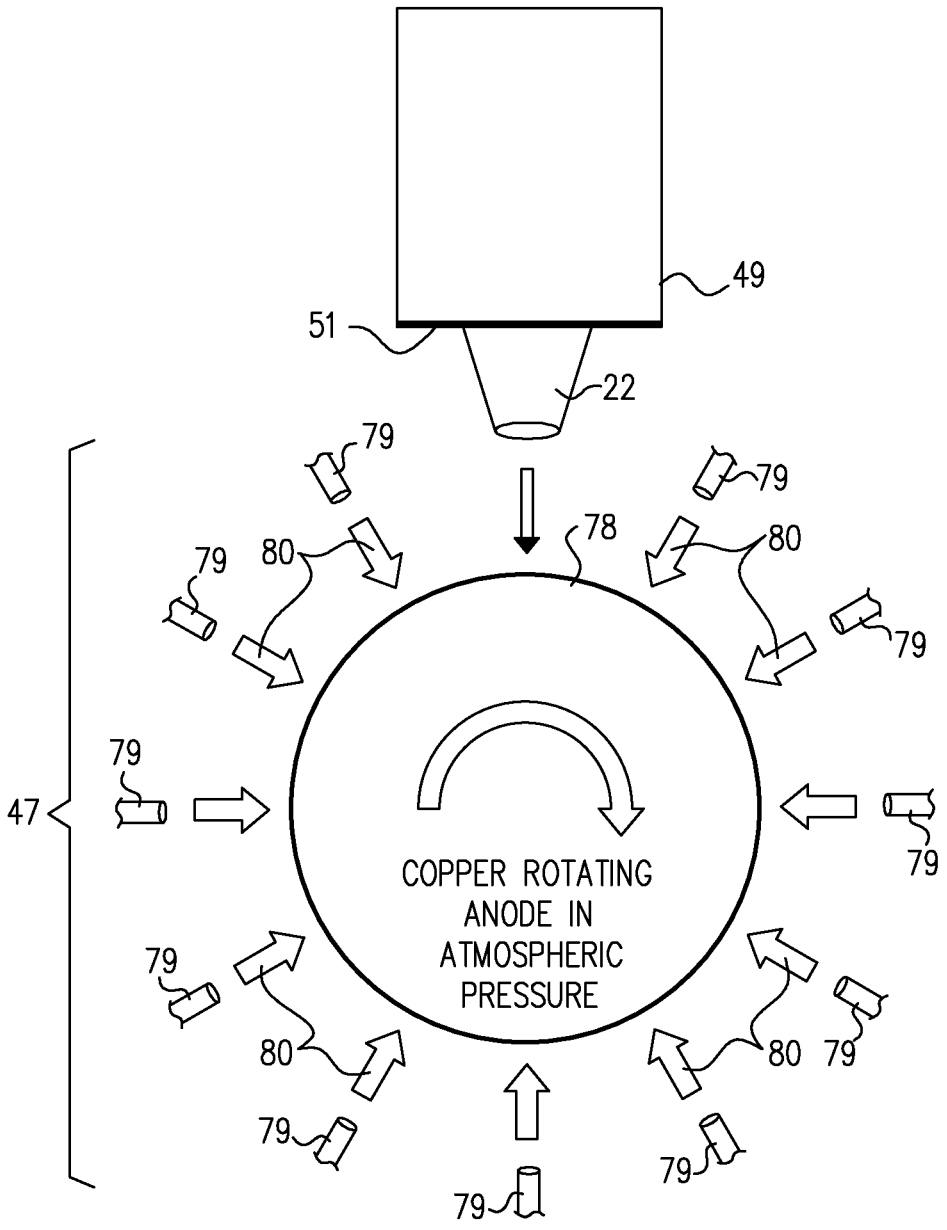
FIG. 9 is a schematic illustration of an X-ray rotational anode, in accordance with an alternative embodiment of the present invention.

FIG. 9 is a schematic illustration of an X-ray anode 47, in accordance with an alternative embodiment of the present invention. The cathode (not shown) is located above beam 22 and is sealed in vacuum environment by a housing 49 that comprises a protective diamond window 51. The window has a substantially similar structure and functionality as diamond film 60 described above. Window 51 allows beam 22 to pass through from housing 49 towards anode 47, which is located in atmospheric pressure, at a typical accelerated voltage of 100 keV.

Anode 47 comprises a round-shaped copper bulk 78 located in close proximity (e.g., 3 mm) to window 51 so as to allow beam 22 to reach bulk 78 at desired illumination conditions and to impinge on bulk 78 so as to generate X-ray photons. Anode 47 further comprises an array of gas pipes 79 located around bulk 78, which are configured to blow forced cooling air 80 on the surface of bulk 78. In some embodiments, bulk 78 is configured to rotate so as to reduce the exposure time of any given point on the surface of bulk 78, to beam 22. Operating the anode in atmosphere allows to increase the operating temperature without causing sublimation to the bulk material. The disclosed techniques also allow using a simplified rotation mechanism (compared to rotation in vacuum) and improve the cooling efficiency by using forced air (or any other suitable gas) in addition to water cooling of a conventional rotating anode.

The examples of FIGS. 1-9 refer to a specific X-ray tube configuration. This configuration, however, is chosen purely for the sake of conceptual clarity. In alternative embodiments, the disclosed techniques can be used, mutatis mutandis, in various other types of X-ray tubes and X-ray sources.

It will be appreciated that the embodiments described above are cited by way of example, and that the following claims are not limited to what has been particularly shown and described hereinabove. Rather, the scope includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. An X-ray tube, comprising:

a cathode, which is configured to generate an electron beam;

a round anode, which is configured to rotate such that the electron beam impinges on a rotating surface of the anode so as to emit at least one X-ray beam; and an array of gas pipes, which is configured to direct gas onto the surface so as to cool the anode.

2. The tube according to claim 1, wherein the anode operates at atmospheric pressure.

3. The tube according to claim 2, and comprising a vacuum housing, which contains the cathode in a vacuum environment.

4. The tube according to claim 3, wherein the housing comprises a window, through which the electron beam passes so as to impinge on the anode.

5. The tube according to claim 4, wherein the window comprises a diamond film.

6. The tube according to claim 1, wherein the anode comprises stacked layers of two or more materials, and is configured to emit the at least one X-ray beam at one or more wavelengths corresponding to the materials.

* * * * *